US010046448B2

(12) United States Patent
Wolf et al.

(10) Patent No.: US 10,046,448 B2
(45) Date of Patent: Aug. 14, 2018

(54) FASTENER DRIVING TOOL WITH SAFETY LOCK

(71) Applicant: HILTI Aktiengesellschaft, Schaan (LI)

(72) Inventors: Iwan Wolf, Untervaz (CH); Mario Grazioli, Chur (CH); Karl Franz, Feldkirch (AT); Stefan Miescher, Schaan (LI)

(73) Assignee: Hilti Aktiengesellschaft, Schaan (LI)

( * ) Notice: Subject to any disclaimer, the term of this patent is extended or adjusted under 35 U.S.C. 154(b) by 649 days.

(21) Appl. No.: 14/422,114

(22) PCT Filed: Aug. 13, 2013

(86) PCT No.: PCT/EP2013/066873

§ 371 (c)(1),
(2) Date: Mar. 20, 2015

(87) PCT Pub. No.: WO2014/026966

PCT Pub. Date: Feb. 20, 2014

(65) Prior Publication Data

US 2015/0224637 A1 Aug. 13, 2015

(30) Foreign Application Priority Data

Aug. 17, 2012 (DE) ..... 10 2012 214 694

(51) Int. Cl.
*B25C 1/00* (2006.01)
*B25C 1/06* (2006.01)

(52) U.S. Cl.
CPC ..... *B25C 1/008* (2013.01); *B25C 1/06* (2013.01)

(58) Field of Classification Search
CPC ... B25C 5/16; B25C 1/16; A45C 11/00; G01S 1/00; G01H 1/00; G01P 15/00; B25F 5/00

(Continued)

(56) References Cited

U.S. PATENT DOCUMENTS

2002/0062796 A1 5/2002 Thieleke et al.
2007/0045377 A1* 3/2007 Towfighi ..... B25C 1/06 227/130

(Continued)

FOREIGN PATENT DOCUMENTS

DE 100 32 310 A1 2/2002
DE 10 2005 000 107 A1 3/2007

(Continued)

OTHER PUBLICATIONS

International Search Report, PCT/EP2013/066873, dated Mar. 13, 2014.
Written Opinion, PCT/EP2013/066873, dated Feb. 17, 2015.

*Primary Examiner* — Nathaniel Chukwurah
(74) *Attorney, Agent, or Firm* — Leydig Voit & Mayer

(57) ABSTRACT

A fastener driving tool comprises a hand-held casing having a movable and drivable energy transmission element including a driving member, wherein the driving member acts to drive a fastener, a locking element, and a sensor member for determining an operational state of the fastener driving tool, wherein a driving process is released only if the operational state prevails, wherein the locking member is arranged in a locking manner in a path of the energy transmission element if the non-operational state prevails, wherein, once a driving process has been triggered, the locking member can stop the energy transmission element.

20 Claims, 7 Drawing Sheets

(58) Field of Classification Search
USPC ..... 227/8, 120, 130, 131
See application file for complete search history.

(56) References Cited

U.S. PATENT DOCUMENTS

| | | | | |
|---|---|---|---|---|
| 2010/0147919 | A1 | 6/2010 | Schiestl | |
| 2011/0303428 | A1 | 12/2011 | Roth et al. | |
| 2011/0303726 | A1* | 12/2011 | Blessing | B25C 1/06 227/132 |
| 2011/0303728 | A1* | 12/2011 | Franz | B25C 1/06 227/132 |
| 2012/0160888 | A1 | 6/2012 | Schiestl | |

FOREIGN PATENT DOCUMENTS

| | | | |
|---|---|---|---|
| EP | 2 199 027 | A1 | 6/2010 |
| EP | 2 397 260 | A2 | 12/2011 |
| JP | 54-71270 | U | 5/1979 |
| JP | 11-179674 | A | 7/1999 |

* cited by examiner

FASTENER DRIVING TOOL WITH SAFETY LOCK

BACKGROUND OF THE INVENTION

The invention concerns a fastener driving tool according to the preamble of Claim 1.

DE 100 32 310 A1 describes a driving tool operated with fuel gas, in which a position of a driving piston for function control can be prompted by means of a scanning element.

BRIEF SUMMARY OF THE INVENTION

The goal of the invention is to indicate a driving tool that has a high operating reliability.

This goal is attained for a driving device in accordance with the invention mentioned in the beginning, with the characterizing features of Claim 1. The provisioning of a locking member in the path of the energy transmission element will directly prevent an unwanted or improper impinging of the fastener. In such a case, the stopping of the energy transmission element prevents acting on the fastener. Depending on the design, a considerable fraction of or also a complete kinetic energy can thereby be stopped by the locking member, which would otherwise be transmitted to the fastener.

A fastener in the sense of the invention is thereby understood to be any drivable nail, bolt, pin, or also a clamp or screw. The fastener is driven electrically and is hand-held. The drive can preferably have an electrical energy storage unit like a battery so as to have wireless operation.

The energy transmission element can be designed in any manner known with driving tools. For example, it can be a spring-loaded piston as an energy transmission element, which can be brought under tension by a driving device that comprises a rotatable spindle. The spring can be designed as a metal or plastic spring or also a pneumatic spring. With such tools, bringing the spring under tension is mostly carried out by rotating the spindle by means of an electric motor, for example, until a tensioned state prevails. After a triggering, the piston is accelerated by the spring, so that the piston strikes the fastener and it is driven into a workpiece. A resetting of the piston to its starting position can subsequently be carried out by a further rotation of the spindle, wherein, depending on the design of the mechanism, the rotation direction can be the reverse. Other embodiments that fall under the invention can comprise, for example, fuel gas-operated or compressed air-operated driving tools. In all embodiments, the energy transmission element is thereby impinged on first with a kinetic energy, with the use of an energy source, wherein it then transmits the energy to the fastener, so as to drive it into a workpiece.

A driving member of the energy transmission element in the sense of the invention is understood to be that part which acts directly on the fastener so as to accelerate it. The driving member is frequently, although not necessarily, a plunger. The plunger is mostly designed as a front part of a drivable piston or another component of the energy transmission element. Basically, the locking element can be situated, in a locking manner, directly in a displacement path of the driving member or also in a displacement path of another part of the energy transmission element. It is essential thereby that an acceleration of the fastener be basically prevented.

A sensor member in the sense of the invention is understood to mean any element that is used for the determination of an operating state. It may be a mechanical scanning member, an electromechanical component, a safety switch that is to be activated, a light barrier, or something similar. In particular, a sensor member in the sense of the invention is understood to be a device by means of which an orderly placement or pressing of the driving tool on a workpiece can be determined, so as to prevent an uncontrolled withdrawal of the fastener from the driving tool.

In a particularly preferred embodiment of the invention, another safety device, in addition to the locking member, is provided on the driving tool, wherein the triggering of a driving process is prevented by means of the additional safety device. In contrast to the function of the locking member, merely a triggering is blocked by the additional safety device. Such safety devices are known in many models. A criterion of the activation of the additional safety device can differ from the operational state for the release of the locking member or also be the same criterion. An essential difference between the additional safety device and the function of the locking member is to be found in that an energy transmission to the fastener can be basically prevented by the locking member. Therefore, the locking member is effective even if other safety devices fail due to manipulations, wear and tear, breakage, and the effect of water, ice or other unforeseen circumstances.

With particular preference, a locking member in accordance with the invention is therefore provided supplementary to the safety device, so that, as a whole, a particularly high degree of safety is attained. Basically, however, provision can also be made so that the safety is guaranteed exclusively by the locking member, without additional safety devices. In such a case, the locking member can be appropriately designed so that it can also repeatedly stop the energy transmission element, without relevant components being damaged or suffering fatigue in this way.

In a generally preferred embodiment of the invention, the sensor member comprises a pressing member in a front section of the driving tool, wherein the pressing member for the release of the driving process is braced against a workpiece. Such a pressing member can, for example, be designed as a drivable, sleeve-shaped discharge channel, as a drivable probe bolt, or something similar.

In a generally advantageous embodiment, the locking member comprises a movable slider, wherein the slider is situated in a locking position between the driving member and the fastener, and wherein, in a release position, the slider releases a displacement path of the driving member against the fastener. The positioning between the driving member and the fastener produces the safeguarding in a very effective manner. The locking member is preferably made of a stable material and therefore particularly suitable for stopping the kinetic energy of the driving member or the piston. Moreover, in this way, there is an arrangement of the locking member in a front section of the driving tool, so that, in particular, a mechanical control of the slider can be easily implemented.

In a particularly preferred refinement, the slider is connected with a pressing member via a mechanism, wherein a pressing of the pressing member against a workpiece moves the slider into the release position. Depending on the requirements, the pressing member can, moreover, control one or more additional safety devices of the driving tool. The operational state of the driving tool is produced in a simple and effective manner by the process of pressing against a workpiece.

With a simple and appropriate implementation of a control, the locking member is thereby connected with the pressing member by means of a pressing rod.

With a first possible detail design, the slider can be designed as a rotating slider. With an alternative design, the slider can also be designed as a linear slider.

With a preferred but not necessary construction of a driving tool, an electric motor is available as a driving source. As an alternative, however, another driving form, such as a fuel gas or compressed air, can also be selected.

BRIEF DESCRIPTION OF THE SEVERAL VIEWS OF THE DRAWING(S)

Other features and advantages of the invention can be deduced from the embodiment examples and from the dependent claims. Below, several preferred embodiment examples of the invention are described and explained in more detail with the aid of the appended drawings.

Figure 2:
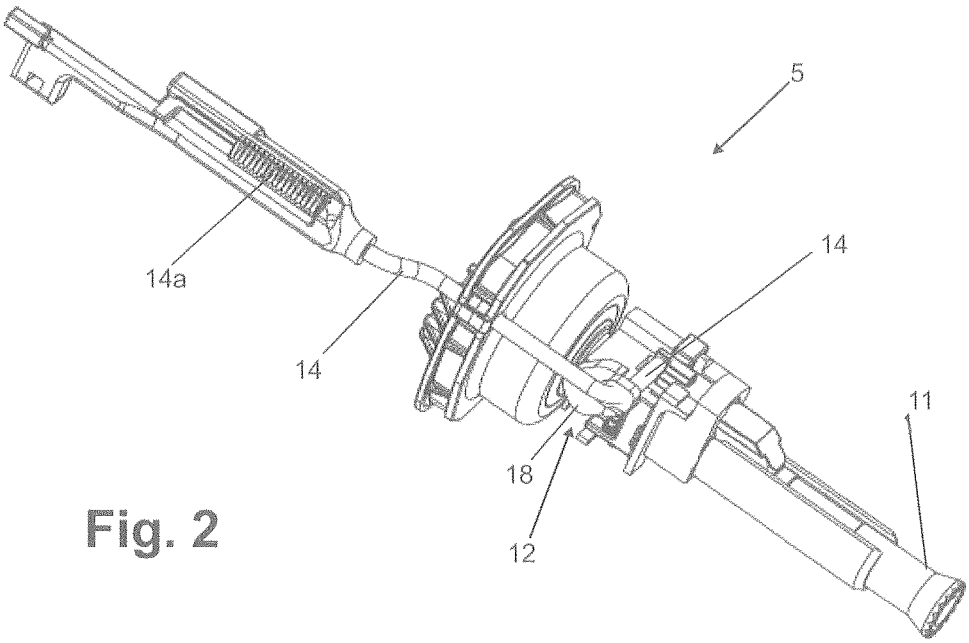
FIG. 2 shows a component of the tool from FIG. 1 with a locking member as a rotating slider in a spatial view in a nonpressed state.
Figure 3A:
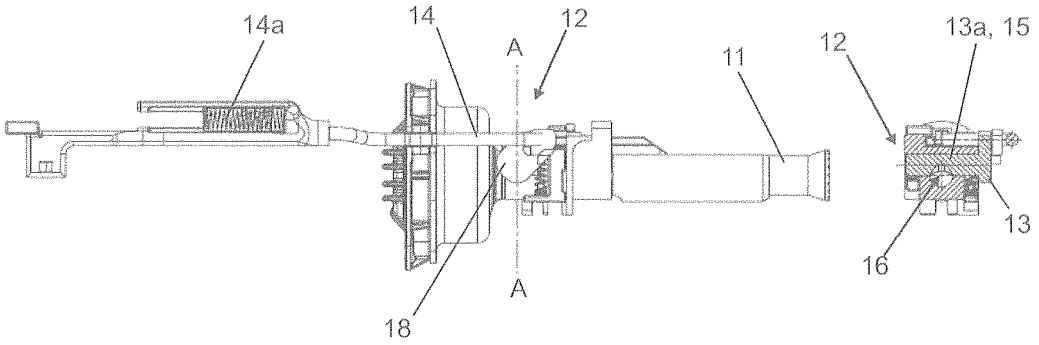

FIG. 3*a* shows the component from FIG. 2 in a lateral top view with a sectional view along line A-A.

Figure 3B:
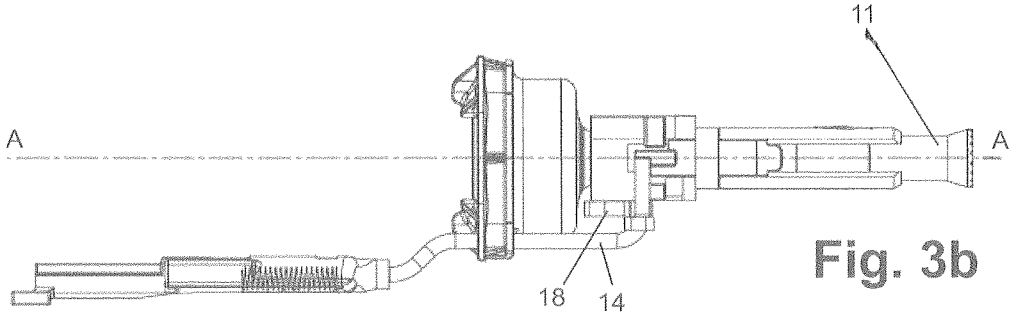

FIG. 3*b* shows the component from FIG. 2 in another lateral top view.

Figure 3C:
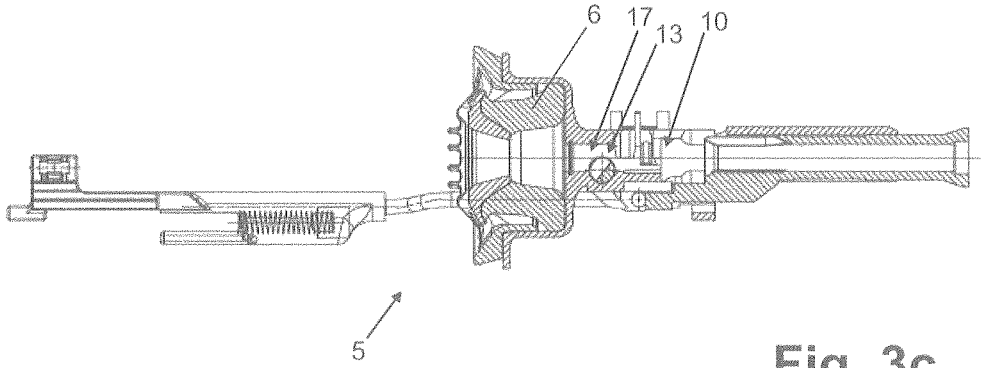

FIG. 3*c* shows a sectional view of the component from FIG. 3*b* along line A-A.

Figure 4:
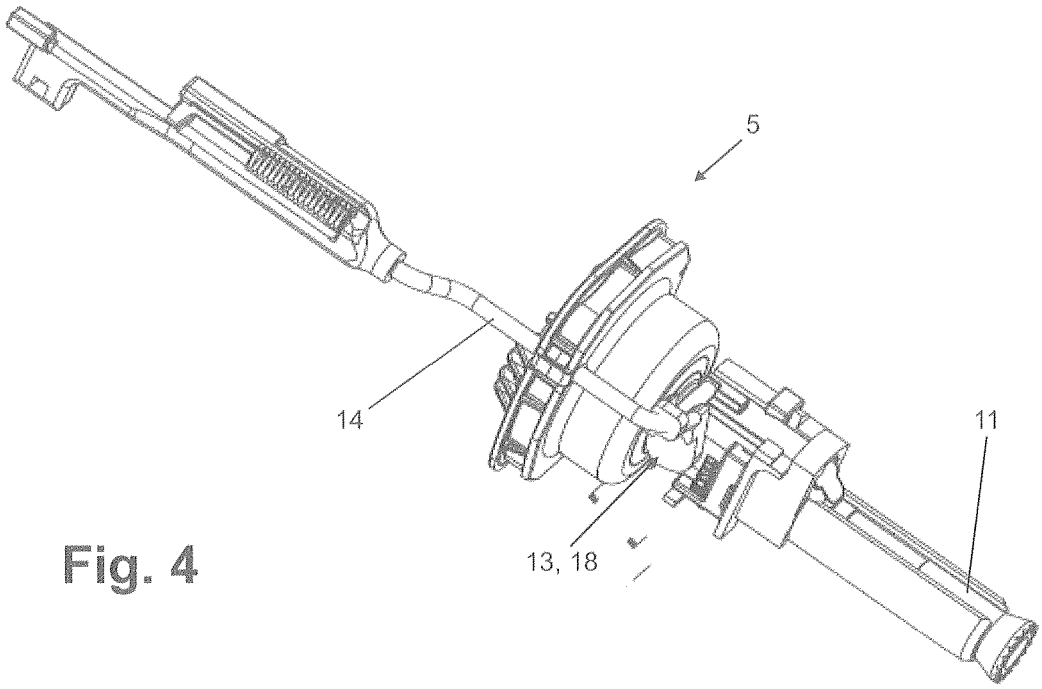

FIG. 4 shows the component from FIG. 2 in a spatial view in a pressed state.

Figure 5A:
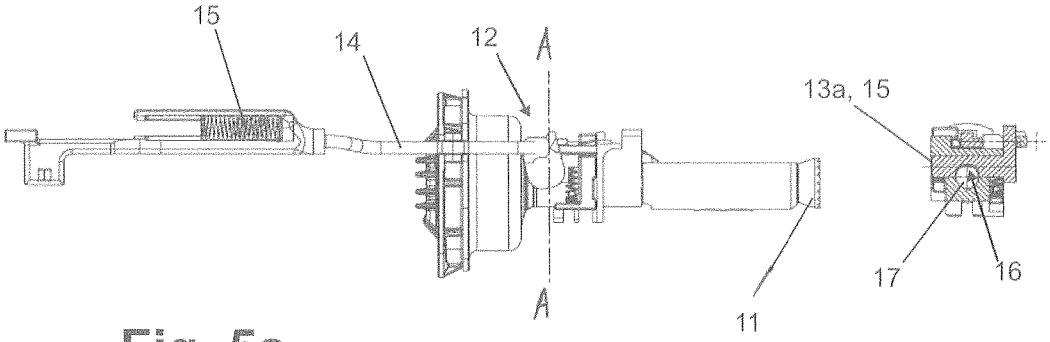

FIG. 5*a* shows the component from FIG. 4 in a lateral top view with a sectional view along line A-A.

Figure 5B:
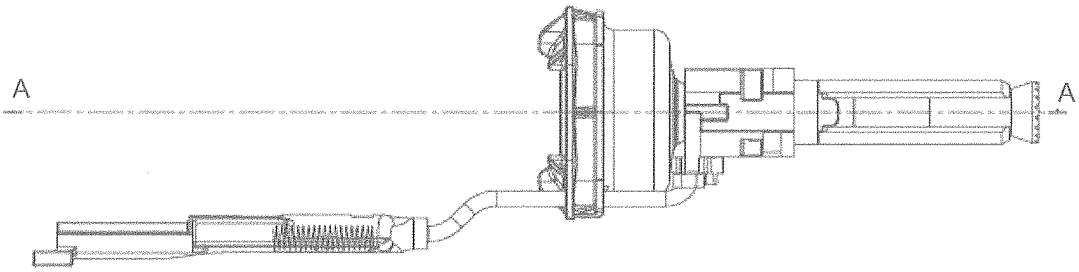

FIG. 5*b* shows the component from FIG. 4 in another lateral top view.

Figure 5C:
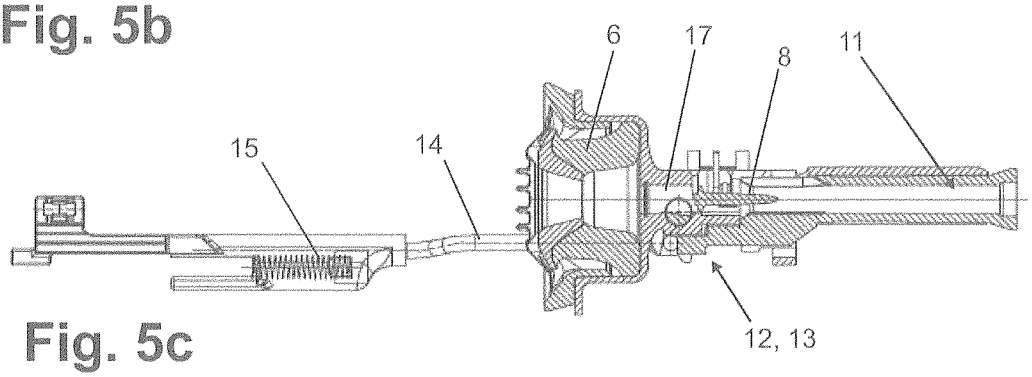

FIG. 5*c* shows a sectional view of the component from FIG. 5*b* along line A-A.

Figure 6:
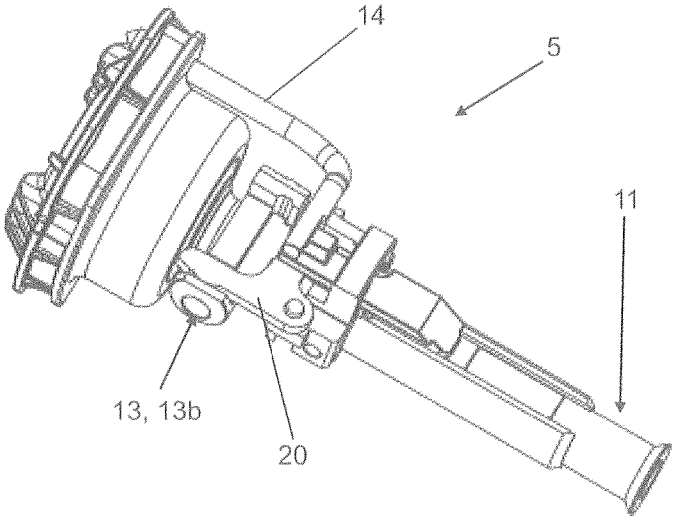

FIG. 6 shows another embodiment of the component from FIG. 2 with a linear slider as a locking member in a nonpressed state.

Figure 7:
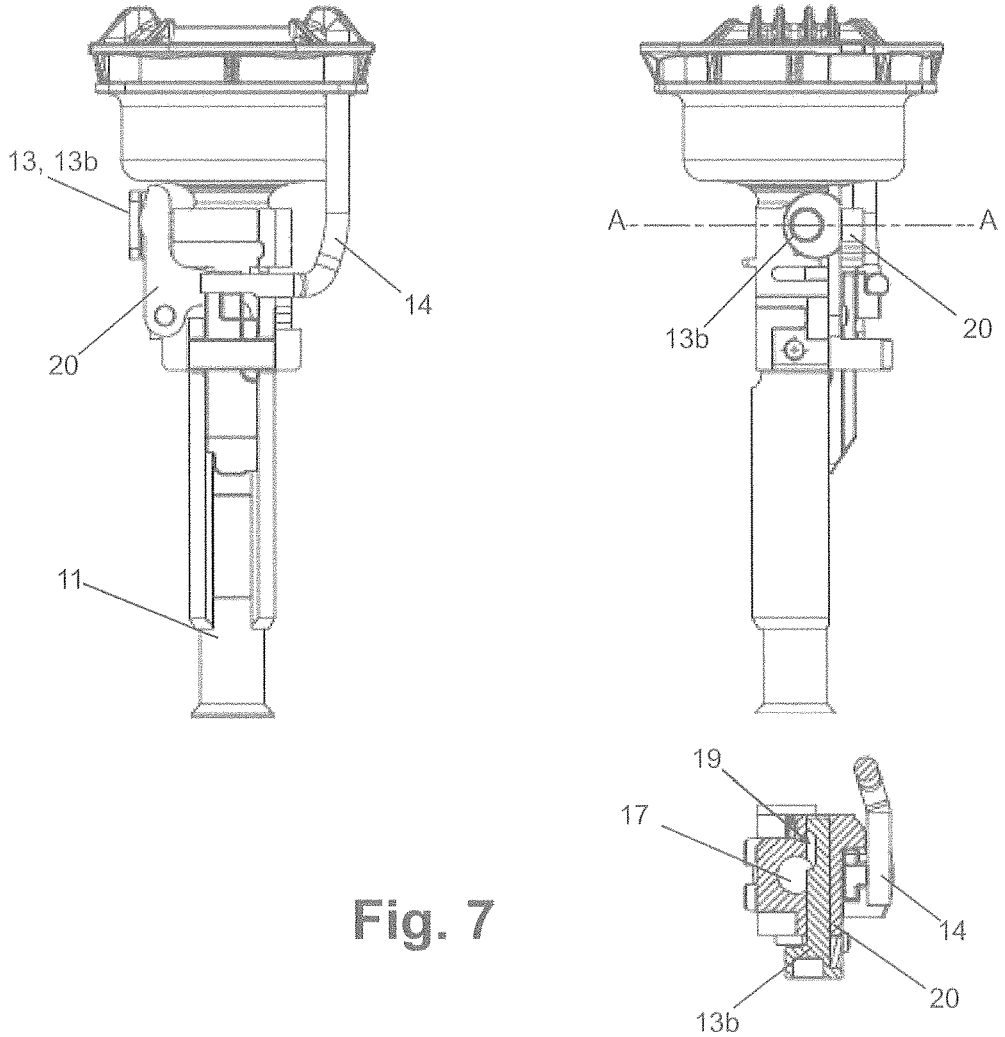

FIG. 7 shows the component from FIG. 6 in two lateral top views and a sectional view along line A-A.

Figure 8:
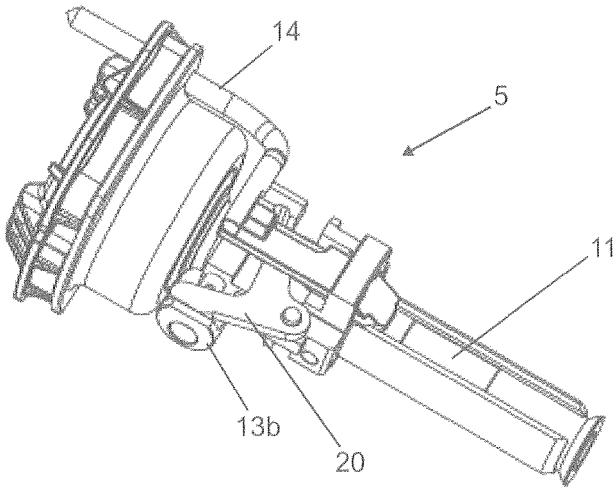

FIG. 8 shows a spatial view of the component from FIG. 6 in a pressed state.

Figure 9:
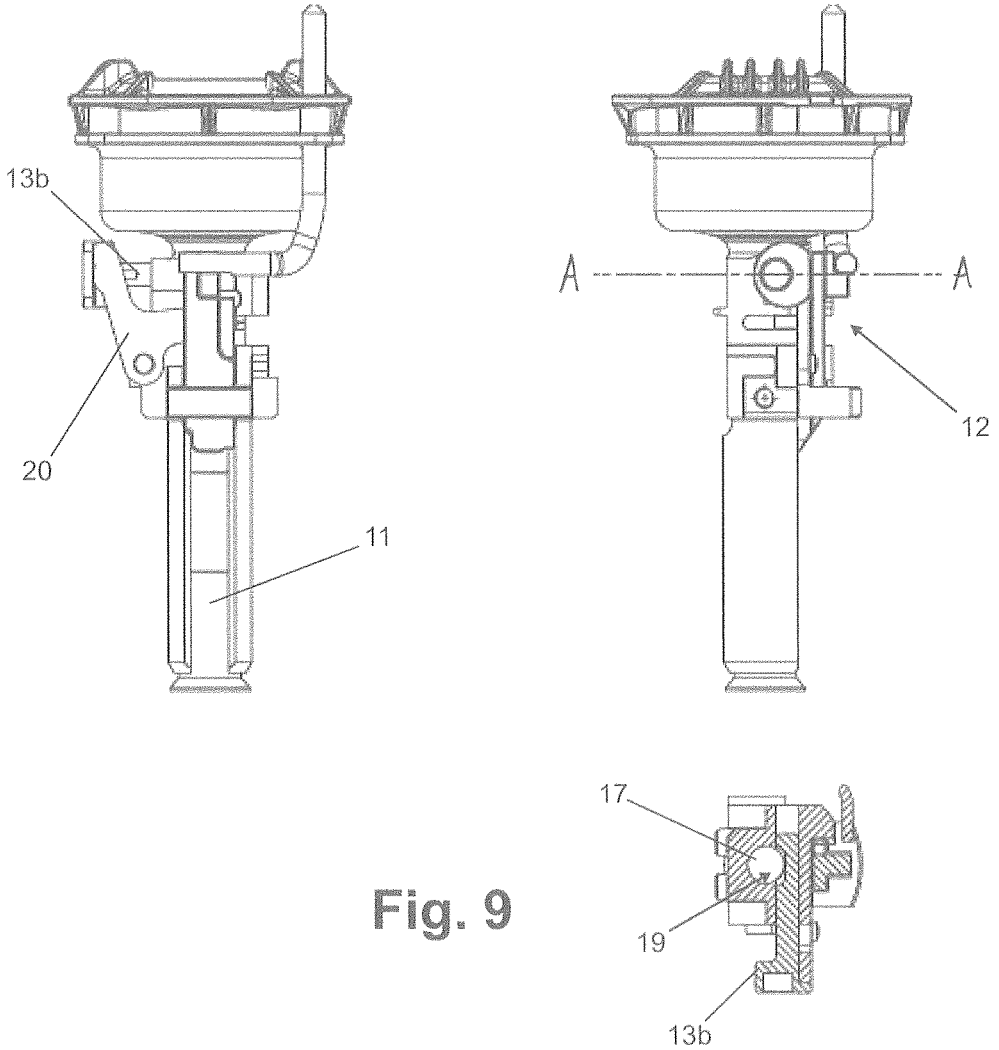

FIG. 9 shows the component from FIG. 7 in two lateral top views and a sectional view along line A-A.

Figure 10:
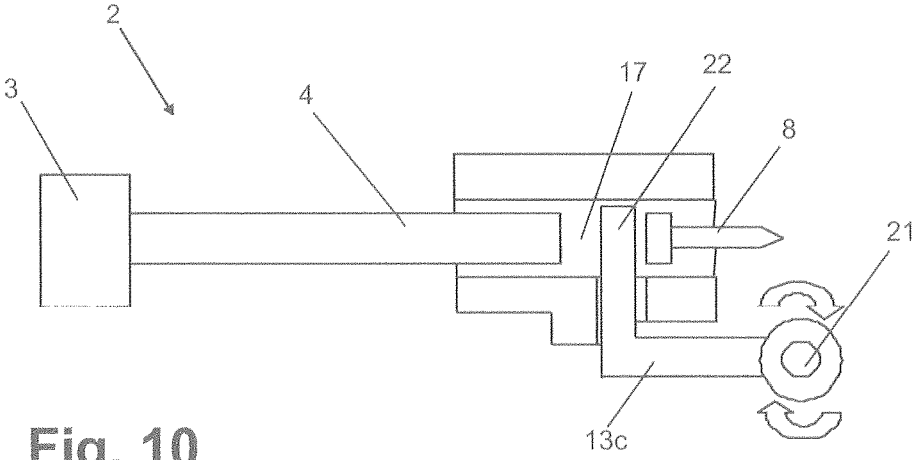

FIG. 10 shows a schematic representation of a locking member with a linear, swiveling slider.

Figure 11:
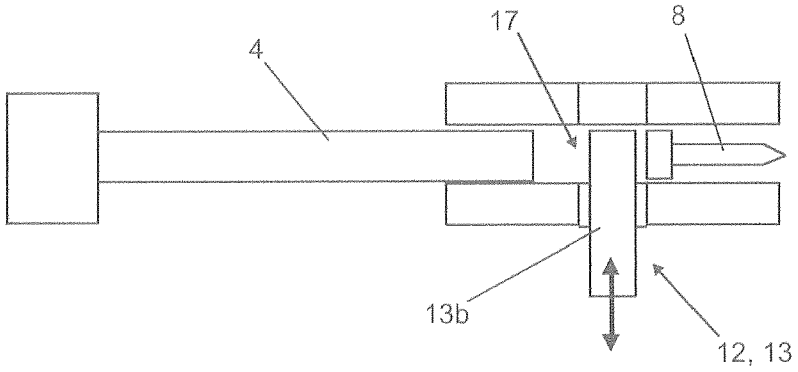

FIG. 11 shows a schematic representation of a locking member with a linear, swiveling slider.

Figure 12:
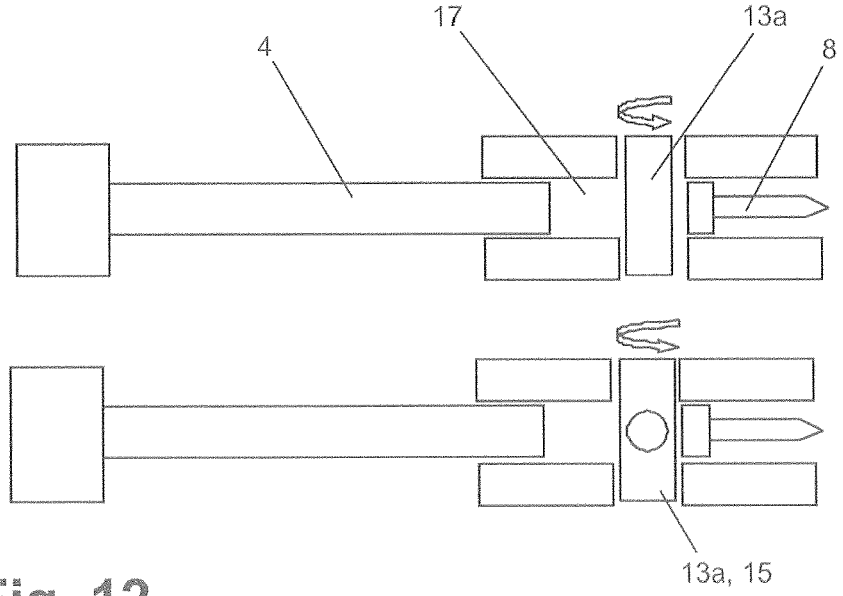

FIG. 12 shows a schematic representation of a locking member with a rotating slider in an open and a closed position.

Figure 13:
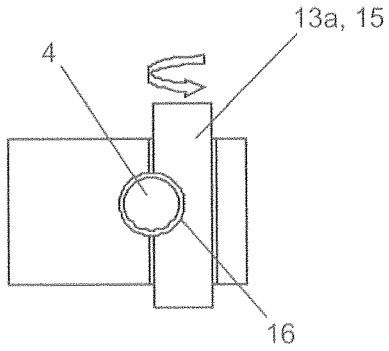

FIG. 13 shows a modification for the rotating slider from FIG. 12.

DETAILED DESCRIPTION OF THE INVENTION

Figure 1:
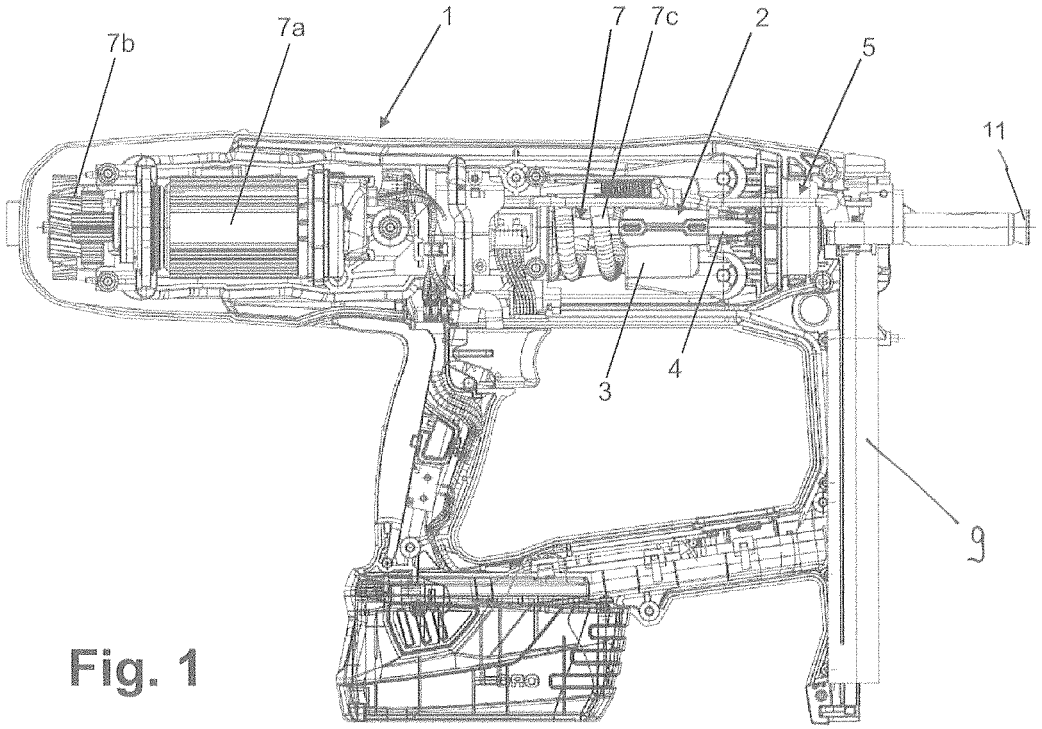
FIG. 1 shows a lateral, partially cut-out total view of a driving tool in accordance with the invention.

The driving tool in accordance with the invention from FIG. 1 comprises a hand-held casing 1, in which an energy transmission element 2 with a driving device 7 is held. The embodiment example under consideration is an electrically operated driving tool. The energy transmission element 2 comprises a linearly moved piston with a driving member 4 in the form of an essentially cylindrical plunger made of a particularly low wear material. A stop 6 (see FIG. 3*c*) for the piston is situated in a front component 5 of the driving tool.

Fasteners 8 (see FIG. 5*c*, FIG. 10) are held in a compartment 9. By a supply mechanism, a fastener is transported into a chamber 10 of the component 5, from where it is accelerated by the action of the driving member 4 and is driven through a sleeve-shaped discharge part 11 into a workpiece (not depicted).

In the case under consideration, the driving device 7 comprises an electric motor 7*a*, a gear 7*b* with a following rotating spindle (not depicted), and a spring element 7*c* for the intermediate storage of mechanical energy, whose end is held in a spring holder 3. Before a triggering of a driving process, a tensioning of the spring element 7*c* and a resetting of the piston to a starting position take place in a known manner. In this operational state, a triggering of the driving process can take place, if other safety criteria are fulfilled.

After a triggering of the driving process, the spring element 7*c* accelerates the piston of the energy transmission element 2 in the direction of the stop 6. The driving element 4 is thereby impacted on the fastener 8 so that it is driven into the workpiece.

A locking member 12 is situated in a path traversed by the driving member 4, wherein the locking member can have a locking arrangement (see, for example, FIGS. 2-3*c*, FIG. 6, FIG. 7, FIG. 10) or a releasing arrangement (see, for example, FIGS. 4-5*c*, FIG. 8, FIG. 9).

The locking element comprises a slider 13, which, depending on the embodiment shown, can be designed as a linear slider or as a rotating slider. If a triggering of the driving tool in the locked state of the locking member 12 is to take place, then the driving member 4 would strike the slider 13 of the locking member 12 and, in this way, stop it in its path. The kinetic energy of the energy transmission element is thereby stopped and not conducted to the fastener.

The driving tool under consideration has, moreover, additional safety devices (not depicted), by means of which a triggering of the tool in a nonoperational state is prevented. If, for reasons of a function disturbance or a manipulation, a triggering should nevertheless take place, then the locking member 12 would intervene as an additional safety, which directly prevents an energy transmission to the fastener.

The additional safety devices can be of a purely mechanical nature or also have electrical switches, such as contacts, photocells, or something similar. In the case under consideration, an operational state for the driving in of the fastener 8 can prevail only if the discharge part 11 is pressed against a workpiece. To this end, the discharge part 11 exhibits a driving capacity by a stroke along its longitudinal direction or in the driving direction. The discharge part 11 is coupled with a pressing rod 14, which is braced against a spring 14*a*. Thus, with a settling of the tool, the pressing rod 14 and the discharge part 11 are again pushed back, and the tool is secured against a triggering of the driving process. The spring-loaded, drivable discharge part 11 therefore forms a pressing member and a sensor member in the sense of the invention.

Moreover, the pressing rod 14 is mechanically connected with the locking member 12, so that by means of the stroke of the pressing rod 14, the slider 13 of the locking member 12 is activated at the same time.

The individual concrete embodiment examples of the invention thereby essentially differ through the design and mechanical control of the locking member 12 with the slider 13.

In the example according to FIGS. 1-5*c*, the slider 13 is designed as a rotating slider 13*a*. This comprises a cylindrical roller 15 with a lateral recess 16 in the form of a cylinder segment. In the locking position, the slider 13*a* partially covers a passage opening 17 for the driving member 4, so that the driving member would strike against the slider. In the release position, the passage opening 17 coincides with the recess 16, so that it is completely free. The slider designed as a rotating slider 13*a* turns via a rotating lever 18, with which the pressing rod 14 is hinged.

In the example according to FIGS. 6-9, the slider 13 is designed as a linear slider 13*b*. In a locked state, the slider 13*b* projects from the side into the passage opening 17 and blocks it (see FIG. 7). In the released position, the slider 13*b* is drawn back by a stroke against the force of a spring (not depicted), so that a recess 19 of the slider 13*b* coincides with the passage opening 17 and releases it. The releasing movement of the linear slider 13*b* is controlled via a swiveling lever 20, hinged with the component 5, wherein the swiveling lever 20 is, in turn, designed as a part of a coupled mechanism with the pressing rod 14 and the discharge part 11.

FIG. 10 shows a schematic representation of another embodiment of a linear slider 13, 13*c*. This is not designed so it can be displaced in a precisely linear manner, but rather it swivels around a hinge 21, wherein a pin 22 of the slider 13*c* swivels into or out of the passage opening 17.

FIG. 11 shows a schematic representation of the principle of the linear slider from FIGS. 6-9.

FIG. 12 shows a schematic representation of a rotating slider in the closed and opened state, wherein the rotating slider 13 is formed as a cylindrical roller with a central borehole 23, directed perpendicular to the cylinder axis. With a corresponding orientation, the borehole 23 releases the passage opening 17.

FIG. 13 schematically shows a modification of such a rotating slider with a non-central recess, which corresponds to the embodiment example according to FIGS. 1-5*c*.

Depending on the requirements, the features of the various embodiment examples can be combined with one another.

The invention claimed is:

1. A driving tool, comprising a hand-held casing containing a drivably movable energy transmission element for transmitting energy to a fastener, the energy transmission element including a driving member producing a driving-in action onto the fastener, a locking member, and a sensor member for determining an operational state of the driving tool, wherein a driving process including producing the driving-in action onto the fastener occurs only when the operational state prevails, and, the locking member is situated in a locking manner across a path of the energy transmission element when the nonoperational state prevails, wherein the locking member stops the energy transmission element after a triggering of a driving process such that driving-in action onto the fastener does not occur.

2. The driving tool according to claim 1, wherein the locking member comprises a movable slider situated in a locking position between the driving member and the fastener, and wherein, in a release position, the slider allows the driving member to produce the driving-in action onto the fastener.

3. The driving tool according to claim 2, wherein the slider is connected with a pressing member via a mechanism, and pressing of the pressing member moves against a workpiece to move the slider into the release position.

4. The driving tool according to claim 3, wherein the locking member is connected with the pressing member by a pressing rod.

5. The driving tool according to claim 4, wherein the slider is a rotating slider.

6. The driving tool according to claim 4, wherein the slider is a linear slider.

7. The driving tool according to claim 4, wherein the driving tool has an electric motor as a driving source.

8. The driving tool according to claim 3, wherein the slider is a rotating slider.

9. The driving tool according to claim 3, wherein the slider is a linear slider.

10. The driving tool according to claim 3, wherein the driving tool has an electric motor as a driving source.

11. The driving tool according to claim 3, wherein the sensor member-comprises a pressing member in a front section of the driving tool, wherein the driving process including producing the driving-in action onto the fastener only occurs when the pressing member is braced against a workpiece.

12. The driving tool according to claim 2, wherein the slider is a rotating slider.

13. The driving tool according to claim 12, wherein the driving tool has an electric motor as a driving source.

14. The driving tool according to claim 2, wherein the slider is a linear slider.

15. The driving tool according to claim 14, wherein the driving tool has an electric motor as a driving source.

16. The driving tool according to claim 2, wherein the driving tool has an electric motor as a driving source.

17. The driving tool according to claim 2, wherein the sensor member-comprises a pressing member in a front section of the driving tool, wherein the driving process including producing the driving-in action onto the fastener only occurs when the pressing member is braced against a workpiece.

18. The driving tool according to claim 1, wherein the driving tool has an electric motor as a driving source.

19. The driving tool according to claim 1, wherein the sensor member comprises a pressing member in a front section of the driving tool, wherein the driving process including producing the driving-in action onto the fastener only occurs when the pressing member is braced against a workpiece.

20. The driving tool according to claim 1, wherein in addition to the locking member, an additional safety device is provided on the driving tool, wherein triggering of a driving process is prevented the additional safety device.

* * * * *